US009507313B2

(12) United States Patent
Terai et al.

(10) Patent No.: US 9,507,313 B2
(45) Date of Patent: Nov. 29, 2016

(54) IMAGE FORMING APPARATUS WITH REMOVABLE UNIT AND A CONNECTABLE DEVICE TO CONNECT TO THE REMOVABLE UNIT

(71) Applicants: Junichi Terai, Kanagawa (JP); Tadashi Ogawa, Tokyo (JP); Hiroyuki Mabuchi, Kanagawa (JP); Yukio Otome, Ibaraki (JP); Hideki Kimura, Kanagawa (JP); Hiroshi Kikuchi, Kanagawa (JP); Hiroaki Okamoto, Kanagawa (JP)

(72) Inventors: Junichi Terai, Kanagawa (JP); Tadashi Ogawa, Tokyo (JP); Hiroyuki Mabuchi, Kanagawa (JP); Yukio Otome, Ibaraki (JP); Hideki Kimura, Kanagawa (JP); Hiroshi Kikuchi, Kanagawa (JP); Hiroaki Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/982,709

(22) Filed: Dec. 29, 2015

(65) Prior Publication Data

US 2016/0202660 A1 Jul. 14, 2016

(30) Foreign Application Priority Data

Jan. 14, 2015 (JP) ..... 2015-005351

(51) Int. Cl.
*G03G 21/00* (2006.01)
*G03G 21/10* (2006.01)
(Continued)

(52) U.S. Cl.
CPC ..... *G03G 21/10* (2013.01); *G03G 21/12* (2013.01); *G03G 21/168* (2013.01); *G03G 21/1647* (2013.01); *G03G 2221/1624* (2013.01); *G03G 2221/1642* (2013.01)

(58) Field of Classification Search
CPC .. G03G 21/10; G03G 21/12; G03G 21/1676; G03G 21/168; G03G 21/169; G03G 21/1695; G03G 2221/0057; G03G 2221/0063; G03G 2221/1618; G03G 2221/1624; G03G 2221/163; G03G 2221/1642; G03G 21/1647
USPC ..... 399/98, 99, 111, 119, 120, 121, 123, 399/124
See application file for complete search history.

(56) References Cited

U.S. PATENT DOCUMENTS 6,178,305 B1 * 1/2001 Sato ..... G03G 15/0875 399/111
2009/0269112 A1 * 10/2009 Fukunaga ..... G03G 21/12 399/360

(Continued)

FOREIGN PATENT DOCUMENTS

JP 57109972 A * 7/1982
JP 63121874 A * 5/1988

(Continued)

OTHER PUBLICATIONS

U.S. Appl. No. 14/807,317, filed Jul. 23, 2015.

*Primary Examiner* — Robert Beatty
(74) *Attorney, Agent, or Firm* — Oblon, McClelland, Maier & Neustadt, L.L.P.

(57) ABSTRACT

An image forming apparatus includes a removable unit to be removably installed in the image forming apparatus, having a unit-side opening, a connectable device having an apparatus-side opening to be connected to the unit-side opening to send developer from one of the removable unit and the connectable device to the other, a receptacle disposed below the unit-side opening and the apparatus-side opening to receive and store developer dropping from above, and a drawer unit to be retractably drawn out from the image forming apparatus. The receptacle is united with the drawer unit to be drawn out from the image forming apparatus together with the drawer unit.

16 Claims, 8 Drawing Sheets

(51) Int. Cl.
*G03G 21/16* (2006.01)
*G03G 21/12* (2006.01)

(56) References Cited

U.S. PATENT DOCUMENTS

| | | | | |
|---|---|---|---|---|
| 2012/0099885 | A1* | 4/2012 | Hasebe | G03G 15/0879 399/98 |
| 2014/0064794 | A1 | 3/2014 | Takahashi et al. | |
| 2014/0119780 | A1 | 5/2014 | Hori et al. | |
| 2014/0233984 | A1 | 8/2014 | Miyoshi et al. | |
| 2014/0270860 | A1* | 9/2014 | Asai | G03G 15/0815 399/283 |
| 2014/0341618 | A1 | 11/2014 | Otome et al. | |
| 2014/0376951 | A1 | 12/2014 | Ogawa et al. | |
| 2014/0376970 | A1 | 12/2014 | Kimura et al. | |
| 2015/0023700 | A1 | 1/2015 | Nakamoto et al. | |
| 2015/0037050 | A1 | 2/2015 | Kimura et al. | |
| 2015/0043946 | A1 | 2/2015 | Takami et al. | |
| 2015/0063875 | A1 | 3/2015 | Ohshima et al. | |
| 2015/0147096 | A1 | 5/2015 | Hori et al. | |
| 2015/0234318 | A1 | 8/2015 | Takahashi et al. | |

FOREIGN PATENT DOCUMENTS

| | | | |
|---|---|---|---|
| JP | 03068980 | A * | 3/1991 |
| JP | 04217272 | A * | 8/1992 |
| JP | 11-133734 | | 5/1999 |
| JP | 11-231630 | | 8/1999 |
| JP | 2003-156934 | | 5/2003 |
| JP | 2006-018031 | | 1/2006 |
| JP | 2007304314 | A * | 11/2007 |
| JP | 2009-025784 | | 2/2009 |
| JP | 2011-039569 | | 2/2011 |

* cited by examiner

IMAGE FORMING APPARATUS WITH REMOVABLE UNIT AND A CONNECTABLE DEVICE TO CONNECT TO THE REMOVABLE UNIT

CROSS-REFERENCE TO RELATED APPLICATIONS

This patent application is based on and claims priority pursuant to 35 U.S.C. §119(a) to Japanese Patent Application No. 2015-005351, filed on Jan. 14, 2015, in the Japan Patent Office, the entire disclosure of which is hereby incorporated by reference herein.

BACKGROUND

1. Technical Field

Embodiments of the present invention generally relate to an image forming apparatus, such as a copier, a printer, a facsimile machine, or a multifunction peripheral (MFP) having at least two of copying, printing, facsimile transmission, plotting, and scanning capabilities, that includes a unit removably installed in the image forming apparatus and a connectable device to which the removable unit is connected.

2. Description of the Related Art

Among image forming apparatuses, such as copiers, printers, facsimile machines, or MFPs, there are image forming apparatuses that include a connectable device, such as a toner supply device (or a developer supply device), to which a removable unit, such as a developing device, is connectable.

For example, the developing device is removably installed in the image forming apparatus and has an opening to be connected to an opening of the toner supply device. The toner supply device is configured to supply toner (i.e., developer) to the developing device via the respective openings. The developing device is removed from the toner supply device and installed therein at the time of replacement or maintenance work of the developing device.

SUMMARY

An embodiment of the present invention provides an image forming apparatus that includes a removable unit to be removably installed in the image forming apparatus, having a unit-side opening, a connectable device having an apparatus-side opening to be connected to the unit-side opening to send developer from one of the removable unit and the connectable device to the other, a receptacle disposed below the unit-side opening and the apparatus-side opening to receive and store developer dropping from above, and a drawer unit to be retractably drawn out from the image forming apparatus. The receptacle is united with the drawer unit to be drawn out from the image forming apparatus together with the drawer unit.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
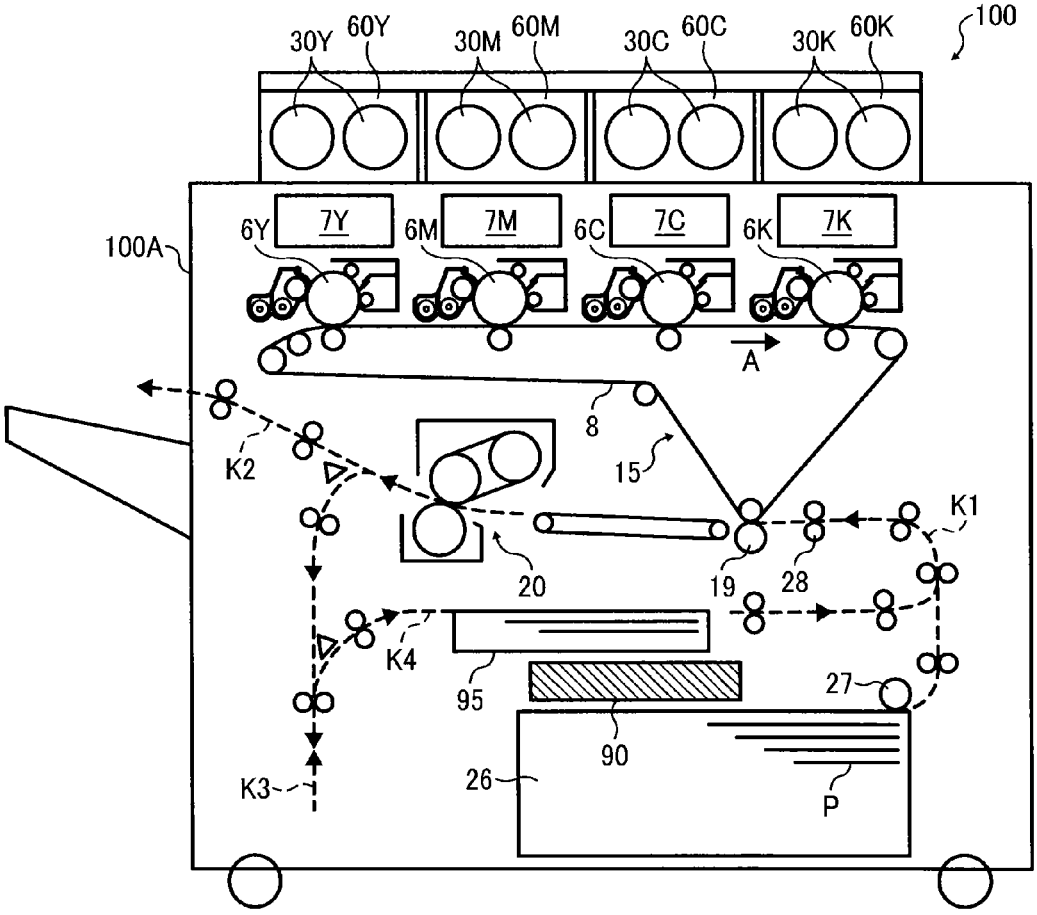
FIG. 1 is a schematic diagram illustrating a configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Embodiments of the present invention are described in detail with reference to drawings. It is to be understood that an identical or similar reference character is given to identical or corresponding parts throughout the drawings, and redundant descriptions are omitted or simplified below.

Figure 2:
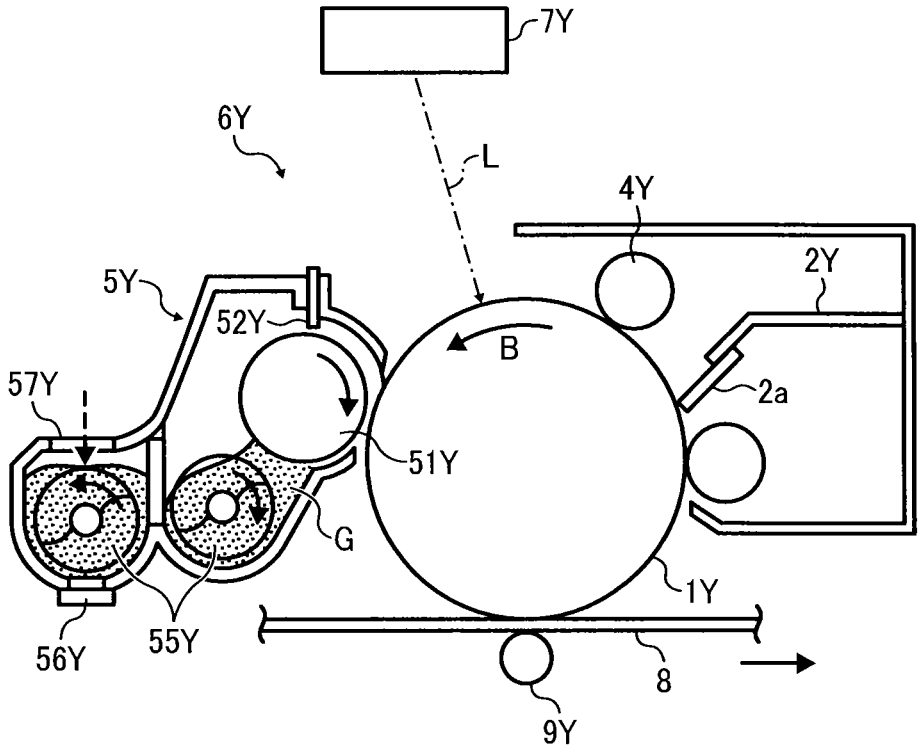
FIG. 2 is a cross-sectional view of a process cartridge and the vicinity thereof in the image forming apparatus illustrated in FIG. 1.

Referring to FIGS. 1 and 2, a configuration and operation of an image forming apparatus according to the present embodiment is described below.

FIG. 1 is a schematic view of an image forming apparatus 100, which in the present embodiment is a printer, for example. FIG. 2 is an enlarged view of a process cartridge 6Y and the vicinity thereof in the image forming apparatus 100 illustrated in FIG. 1.

As illustrated in FIG. 1, toner supply devices 60Y, 60M, 60C, and 60K (i.e., developer supply devices) are disposed above a body 100A of the image forming apparatus 100. In the toner supply devices 60Y, 60M, 60C, and 60K, two toner containers 30Y for yellow, two toner containers 30M for magenta, two toner containers 30C for cyan, and two toner containers 30K for black are respectively removably mounted. The toner containers 30Y, 30M, 30C, and 30K serve as developer containers and are substantially cylindrical in the present embodiment. Below the toner supply devices 60Y, 60M, 60C, and 60K (i.e., apparatus-side connectable devices), process cartridges 6Y, 6M, 6C, and 6K, respectively corresponding to yellow, magenta, cyan, and black, are disposed facing an intermediate transfer unit 15 with exposure devices 7Y, 7M, 7C, and 7K interposed therebetween.

Referring to FIG. 2, the process cartridge 6Y for yellow is a removable unit removably mounted in the body 100A and connectable to the toner supply devices 60Y. The process cartridge 6Y includes a photoconductor drum 1Y serving as an image bearer and further includes a charging device 4Y, a developing device 5Y, and a cleaning device 2Y disposed around the photoconductor drum 1Y. Image forming process, namely, charging, exposure, development, transfer, and cleaning processes are performed on the photoconductor drum 1Y, and thus a yellow toner image is formed on the photoconductor drum 1Y.

It is to be noted that other process cartridges 6M, 6C, and 6K have a similar configuration to that of the yellow process cartridge 6Y except the color of the toner used therein and form magenta, cyan, and black toner images, respectively. Thus, only the process cartridge 6Y is described below and descriptions of other process cartridges 6M, 6C, and 6K are omitted.

Referring to FIG. 2, the photoconductor drum 1Y is rotated counterclockwise in FIG. 2 by a driving motor as indicated by arrow B. A surface of the photoconductor drum 1Y is charged uniformly at a position facing the charging device 4Y by the charging device 4Y (a charging process).

When the photoconductor drum 1Y reaches a position to receive a laser beam L emitted from the exposure device 7Y (i.e., a writing device), the photoconductor drum 1Y is scanned with the laser beam L, and thus an electrostatic latent image for yellow is formed thereon (an exposure process).

Then, the photoconductor drum 1Y reaches a position facing the developing device 5Y, where the latent image is developed with toner into a yellow toner image (a development process).

When the surface of the photoconductor drum 1Y carrying the toner image reaches a position facing a primary transfer roller 9Y via an intermediate transfer belt 8, the toner image is transferred therefrom onto the intermediate transfer belt 8 (a primary transfer process). After the primary transfer process, a certain amount of toner tends to remain untransferred on the photoconductor drum 1Y.

When the surface of the photoconductor drum 1Y reaches a position facing the cleaning device 2Y, a cleaning blade 2*a* collects the untransferred toner from the photoconductor drum 1Y into the cleaning device 2Y (a cleaning process).

Subsequently, a discharger removes residual potential on the surface of the photoconductor drum 1Y.

Thus, a sequence of image forming processes performed on the photoconductor drum 1Y is completed.

The above-described image forming processes are performed in the process cartridges 6M, 6C, and 6K similarly to the yellow process cartridge 6Y. That is, the exposure devices 7M, 7C, and 7K disposed above the process cartridges 6M, 6C, and 6K in FIG. 1 direct the laser beams L according to image data onto the photoconductor drums 1M, 1C, and 1K in the process cartridges 6M, 6C, and 6K. Specifically, the exposure device 7 includes a light source to emit the laser beam L, multiple optical elements, and a polygon mirror that is rotated by a motor. The laser beam L is directed to the photoconductor drums 1 via the multiple optical elements while being deflected by the polygon mirror.

Then, the toner images formed on the respective photoconductor drums 1 through the development process are primarily transferred therefrom and superimposed one on another on the intermediate transfer belt 8. Thus, a multicolor toner image is formed on the intermediate transfer belt 8.

In FIG. 1, the intermediate transfer unit 15, serving as a drawer unit, includes the intermediate transfer belt 8, the four primary transfer rollers 9, a driving roller, a secondary transfer backup roller, multiple tension rollers, a cleaning backup roller, and a belt cleaner. The intermediate transfer belt 8 is supported by and entrained around multiple rollers to rotate in the direction, indicated by arrow A illustrated in FIG. 1 (clockwise) as one (the driving roller) of the multiple rollers rotates.

Specifically, the four primary transfer rollers 9 are pressed against the corresponding photoconductor drums 1 via the intermediate transfer belt 8, and four contact portions between the primary transfer rollers 9 and the corresponding photoconductor drums 1 are hereinafter referred to as primary transfer nips. A transfer voltage (a primary transfer bias) opposite in polarity to the toner is applied to each primary transfer roller 9.

The intermediate transfer belt 8 rotates in the direction indicated by arrow A in FIG. 1 and sequentially passes through the primary transfer nips. Then, the single-color toner images are transferred from the respective photoconductor drums 1 primarily and superimposed one on another on the intermediate transfer belt 8.

Then, the intermediate transfer belt 8 carrying the multicolor toner image reaches a position facing the secondary transfer roller 19. The secondary transfer backup roller and the secondary transfer roller 19 press against each other via the intermediate transfer belt 8, and the contact portion therebetween is hereinafter referred to as a secondary transfer nip. The multicolor toner image on the intermediate transfer belt 8 is transferred onto a sheet P (a recording medium) transported to the secondary transfer nip (a secondary transfer process). A certain amount of toner tends to remain untransferred on the intermediate transfer belt 8 after the secondary transfer process.

When the intermediate transfer belt 8 reaches a position facing the belt cleaner, untransferred toner is collected from the intermediate transfer belt 8 by the belt cleaner.

Thus, a sequence of image forming processes performed on the intermediate transfer belt 8 is completed.

Referring back to FIG. 1, the sheet P is transported from a sheet feeder 26 (a sheet tray in particular) disposed below the body 100A to the secondary transfer nip through a sheet feeding path K1, along which a sheet feeding roller 27 and a registration roller pair 28 are disposed.

Specifically, the sheet feeder 26 contains multiple sheets P piled one on another. The sheet feeding roller 27 rotates counterclockwise in FIG. 1 to feed the sheet P on the top in the sheet feeder 26 toward a nip of the registration roller pair 28.

The registration roller pair 28 stops rotating temporarily, stopping the sheet P with a leading edge of the sheet P nipped therebetween. The registration roller pair 28 resumes rotating to transport the sheet P to the secondary transfer nip, timed to coincide with the arrival of the multicolor toner image formed on the intermediate transfer belt 8. Thus, the multicolor toner image is recorded on the sheet P.

The sheet P carrying the multicolor toner image is transported to a fixing device 20. In the fixing device 20, a fixing belt and a pressing roller apply heat and pressure to the sheet P to fix the multicolor toner image on the sheet P (fixing process).

Subsequently, the sheet P is transported through a discharge path K2 and discharged by a pair of discharge rollers outside the image forming apparatus 100. The sheets P are sequentially stacked as output images on a stack tray.

Thus, a sequence of image forming processes performed in the image forming apparatus is completed.

In single-side printing, the sheet P is discharged after the image is fixed on the front side thereof. By contrast, in duplex printing (duplex print mode) to form images on both sides (front side and back side) of the sheet P, after the fixing process, the sheet P is not guided to the discharge path K2 to be discharged but is guided to a sheet reversal path K3. After the direction in which the sheet P is transported (sheet conveyance direction) is reversed in the sheet reversal path K3, the sheet P is transported through a conveyance path K4 and stacked in a duplex conveyor unit 95. Then, the sheet P is transported again to the secondary transfer roller 19. Then, an image is formed on the back side of the sheet P in the transfer process described above at the position of the secondary transfer roller 19 and fixed thereon by the fixing device 20, after which the sheet P is transported through the discharge path K2 and discharged from the image forming apparatus 100.

The image forming apparatus 100 further includes a waste-toner container 90 disposed close to the sheet feeder 26 and the duplex conveyor unit 95 to collect the untransferred toner collected from the photoconductor drum 1Y by the cleaning device 2Y and the untransferred toner collected from the intermediate transfer belt 8 by the belt cleaner. The waste-toner container 90 is removably mounted in the image forming apparatus 100.

Next, a configuration and operation of the developing device 5Y is described in further detail below with reference to FIG. 2.

A casing of the developing device 5Y to contain the developer G is divided, at least partially, into two developer containing compartments. The developing device 5Y includes a developing roller 51Y disposed facing the photoconductor drum 1Y, a doctor blade 52Y disposed facing the developing roller 51Y, two conveying screws 55Y respectively disposed in the developer containing compartments, a concentration detector 56Y to detect concentration (percentage) of toner in developer G or toner density, and an opening 57Y for supply of toner (developer) to the developer containing compartment. The developing roller 51Y includes a stationary magnet or magnet roller disposed inside the developing roller 51Y, a sleeve that rotates around the magnet, and the like. The developer containing compartments contain two-component developer G including carrier (carrier particles) and toner (toner particles).

The developing device 5Y operates as follows.

The sleeve of the developing roller 51Y rotates in the direction indicated by an arrow illustrated in FIG. 2. The developer G is carried on the developing roller 51Y due to the magnetic field generated by the magnet. As the sleeve rotates, the developer G moves along the circumference of the developing roller 51Y (in the direction of arc).

The percentage (concentration) of toner in the developer G (ratio of toner to carrier) in the developing device 5Y is adjusted to a predetermined range. Specifically, according to the consumption of toner in the developing device 5Y, the toner supply device 60Y (illustrated in FIG. 3) supplies toner (i.e., powder) from the toner container 30Y (developer container), and the toner is supplied to the developing device 5Y (the developer containing compartment in particular) via a reservoir 66 of the toner supply device 60Y. The configuration and operation of the toner containers 30Y and the toner supply device 60 are described in further detail later.

While being stirred with the developer G and circulated by the two conveying screws 55Y in the developing device 5Y (the developer containing compartments), the supplied toner is circulated between the two developer containing compartments in a longitudinal direction of the developing device 5Y, which is perpendicular to the surface of the paper on which FIG. 2 is drawn. The toner in two-component developer G is charged by friction with carrier and electrostatically attracted to the carrier. Then, the toner is carried on the developing roller 51Y together with the carrier by a magnetic force generated on the developing roller 51Y.

The developer G carried on the developing roller 51Y is transported to the doctor blade 52Y in conformity with the direction of rotation of the sleeve. The amount of developer G on the developing roller 51Y is adjusted by the doctor blade 52Y, after which the developer G is carried to the developing range facing the photoconductor drum 1Y. Then, the toner is attracted to the latent image on the photoconductor drum 1Y by the magnetic field generated in the developing range. As the sleeve rotates, the developer G remaining on the developing roller 51Y reaches an upper part of the developer containing compartment and drops from the developing roller 51Y.

Figure 3:
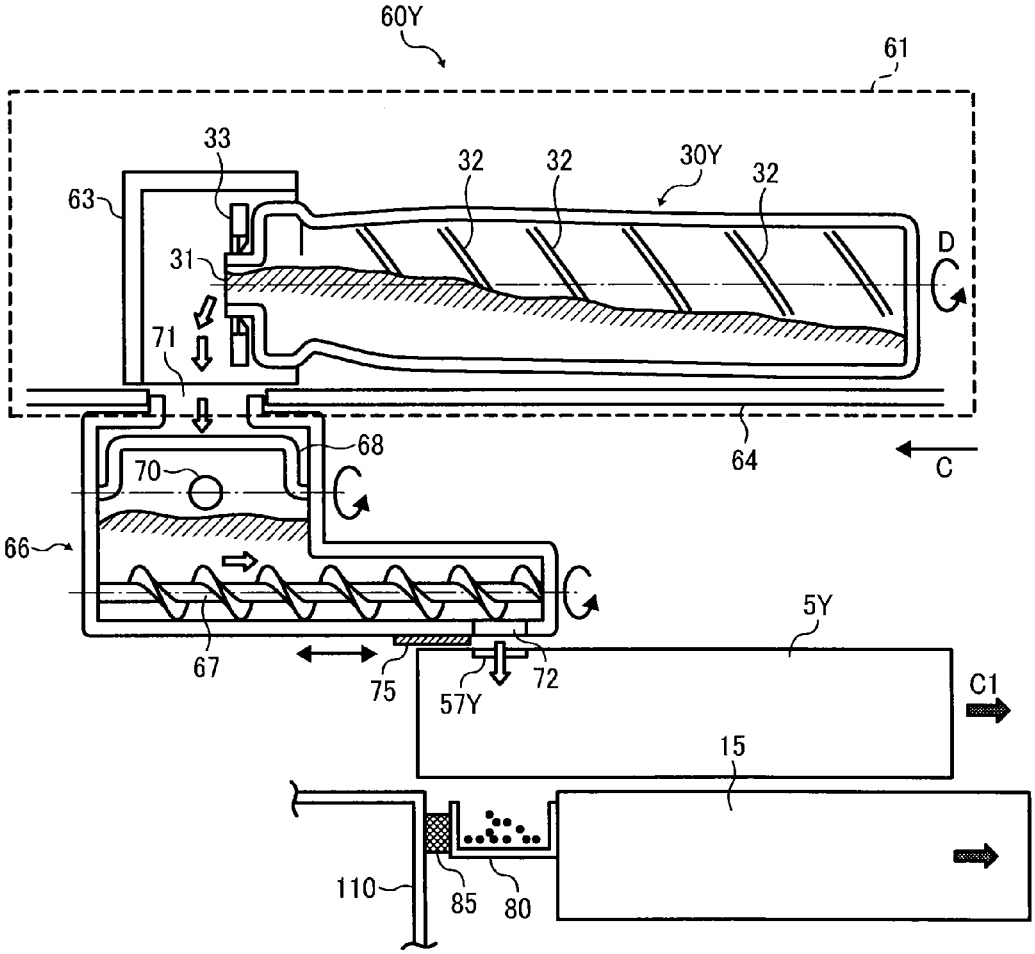
FIG. 3 is a schematic diagram illustrating a toner supply device and a toner container mounted therein, according to an embodiment.

Next, descriptions are given below of toner containers to contain toner supplied to the developing devices with reference to FIGS. 3, 4, and 5. In FIG. 3, reference numeral 110 represents a side plate of the body 100A.

As described above with reference to FIG. 1, in each of the four toner supply devices 60Y, 60M, 60C, and 60K (i.e., the apparatus-side connectable devices), the two toner containers 30 (30Y, 30M, 30C, or 30K) are removably mounted. When the service life of each of the toner containers 30Y, 30M, 30C, and 30K has expired, that is, when almost all toner in the toner container 30 have been consumed, the old one is replaced with a new one. Each toner supply device 60 supplies the toner from the corresponding toner container 30 to the developing device 5 of the corresponding process cartridge 6.

In the present embodiment, two toner containers are used for an identical color toner. Accordingly, a large amount of toner is contained as a whole without increasing the capacity of each toner container.

The two toner containers 30 (for example, 30Y) for an identical color toner are similar in configuration. Additionally, the toner containers 30M, 30C, and 30K are similar in configuration to the toner containers 30Y except the color of toner contained therein. Therefore, one of the toner containers 30Y for yellow is described below, and descriptions of the toner containers 30M, 30C, and 30K for other colors are omitted.

As illustrated in FIG. 3, the toner container 30Y includes a container body, which is substantially cylindrical in the present embodiment, and a cap to close an outlet 31 of the container body.

The outlet 31 (i.e., a toner outlet) is situated in a head of the container body at a leading end in the direction indicated by arrow C, in which the toner container 30Y is inserted into the toner supply device 60Y (hereinafter "insertion direction C"). The head includes a bottle gear 33 that rotates together with the toner container 30Y (i.e., the container body). The toner supply device 60Y includes a driving gear to rotate the container body in the direction indicated by arrow D, around a rotary axis (indicated by alternate long and short dashed lines in FIG. 3), and the bottle gear 33 engages the driving gear of the toner supply device 60Y. The outlet 31 is for discharging toner from the container body to a space inside a cap cover 63 and further to the reservoir 66.

The container body includes a spiral protrusion 32 protruding inward from an outer circumferential face to an inner circumferential face thereof. In other words, a spiral groove is provided in the outer circumferential face of the container body. The spiral protrusion 32 is for discharging toner from the toner container 30Y via the outlet 31 thereof by rotation of the toner container 30Y. For example, the container body is produced together with the bottle gear 33 by blow molding.

Being clamped by a chuck disposed in the toner supply device 60Y, the cap of the toner container 30Y opens and closes the outlet 31 in conjunction with insertion and removal of the toner container 30Y into the toner supply device 60Y. That is, in a state in which the toner container 30Y is held in the toner supply device 60Y, the cap is removed from the outlet 31 to enable discharge of toner from the toner container 30Y as illustrated in FIG. 3. By contrast, when the toner container 30Y is removed from the toner supply device 60Y, the cap is fitted to the outlet 31 of the toner container 30Y to seal the outlet 31. For example, such as structure is stated in JP-H11-231630-A.

The toner container 30Y is inserted into and removed from the toner supply device 60Y of the image forming apparatus 100 as follows.

Figure 5:
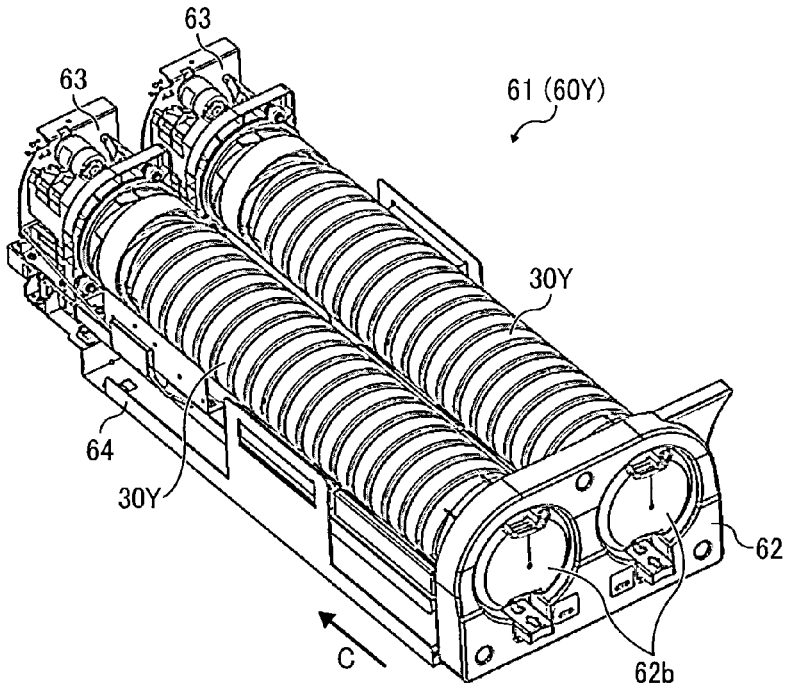
FIG. 5 is a perspective view of a two-mount holder of the toner supply device illustrated in FIG. 3, in which the two toner containers illustrated in FIG. 4 are mounted.

Referring to FIG. 5, the toner supply device 60Y includes a double-mount holder 61 that includes an end support 62 (upstream end support) positioned on a trailing end of the toner supply device 60Y in the insertion direction C. The toner container 30Y is mounted in the toner supply device 60Y as follows. Open a front cover disposed above the body 100A of the image forming apparatus 100 (see FIG. 1) to expose the end support 62 of the double-mount holder 61 in the toner supply device 60Y on the front side of the image forming apparatus 100. Insert the toner container 30Y from an entrance 62*b* (in FIG. 5) of the end support 62 in the insertion direction C, and fit, to the cap cover 63, the head of the toner container 30Y including the outlet 31. Then, the toner container 30Y is rotatably placed on a base 64 illustrated in FIG. 3 (the double-mount holder 61), and insertion of the toner container 30Y is completed. At that time, the bottle gear 33 engages the driving gear of the toner supply device 60Y. Then, the toner supply device 60Y can guide the toner (developer) contained in the toner container 30Y mounted in the toner supply device 60Y to the developing device 5Y.

By contrast, in removal of the toner container 30Y from the toner supply device 60Y, the above-described processes are performed in reverse.

Next, a configuration of the toner supply devices 60 is described below with reference to FIGS. 3 through 6B.

It is to be noted that, in FIG. 3, the orientation of the reservoir 66 relative to the toner container 30Y is different by 90 degrees and components of the reservoir 66 are simplified for ease of understanding. In FIG. 4, the exposure device 7Y illustrated in FIGS. 1 and 2 are omitted for simplicity. Additionally, in FIGS. 3 and 4, the developing device 5Y and the intermediate transfer unit 15 are reduced in longitudinal direction (width direction) and simplified in shape and size.

Since the toner supply devices 60Y, 60M, 60C, and 60K corresponding to different color toners are similar in structure except the color of toner, only the structure for yellow is described below, and descriptions of the structures for other colors are omitted.

The toner supply device 60Y supplies toner from the toner containers 30Y to the developing device 5Y and is disposed above the body 100A of the image forming apparatus 100 in FIG. 1.

In the toner supply device 60Y, the reservoir 66 is situated below the double-mount holder 61, in which the two toner containers 30Y are held. The toner discharged from the two toner containers 30Y drops through the cap cover 63 to the reservoir 66 and stored therein. The reservoir 66 includes a conveying screw 67, an agitator 68, and a toner sensor 70. The reservoir 66 is situated on the back side of the image forming apparatus 100 and the leading side in the insertion direction C (on the back side of the paper on which FIG. 1 is drawn).

Figure 6A:
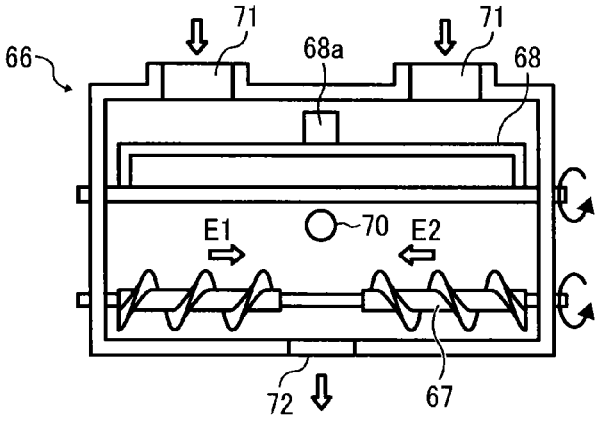
FIG. 6A is a schematic cross-sectional view of a reservoir of the toner supply device illustrated in FIG. 3, as viewed from a front side.
Figure 6B:
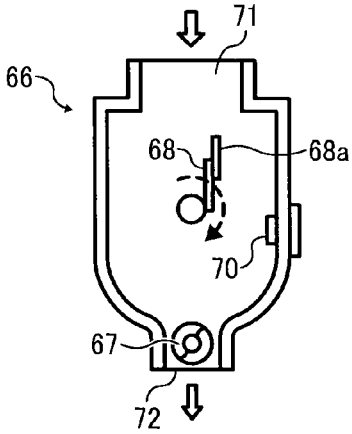
FIG. 6B is a cross-sectional view of the reservoir as viewed from a lateral side.

As illustrated in FIGS. 6A and 6B, above the reservoir 66, two inlets 71 are disposed. Toner flows from the cap covers 63, which communicate with the respective outlets 31 of the two toner containers 30Y, into the inlets 71 of the reservoir 66. The conveying screw 67, the agitator 68, and an opening 72 (an apparatus-side opening) are disposed in a lower part of the reservoir 66. The conveying screw 67 transports the toner flowing from the two inlets 71 to a center part of the reservoir 66 in a lateral direction perpendicular to the insertion direction C. The agitator 68 agitates the toner stored in the reservoir 66. The toner transported to the center part flows out from the opening 72 to the developing device 5Y. The conveying screw 67 includes a shaft, which extends in the lateral direction perpendicular to the insertion direction C, and two screw portions (spiral blades) positioned in first and second end sides in an axial direction of the conveying screw 67. The two screw portions wind around the shaft in the opposite directions to transport toner from the first and second end sides to the center part in the axial direction (as indicated by arrows E1 and E2 in FIG. 6A). As illustrated in FIG. 3, the opening 72 of the reservoir 66 of the toner supply device 60Y (apparatus-side connectable device) is connected to the opening 57Y (supply inlet) of the developing device 5Y (the process cartridge 6Y) serving as the removable unit. As the conveying screw 67 rotates, the toner flows out the opening 72 of the reservoir 66, and the toner is supplied to the developing device 5Y via the opening 57Y.

At a middle height in the reservoir 66 in FIGS. 6A and 6B, the agitator 68 to stir the toner in the reservoir 66 and the toner sensor 70 are disposed. The toner sensor 70 detects the amount of toner to keep the height of toner in the reservoir 66 constant.

The agitator 68 includes a shaft and a substantially U-shaped rod provided to the shaft. A flexible sheet 68*a* made of a plastic sheet such as Mylar® (registered trademark of DuPont) is attached to a center portion of the rod. As the agitator 68 rotates, the flexible sheet 68*a* slidingly contacts a detection face of the toner sensor 70 to clean the detection face.

The toner sensor 70 is, for example, a piezoelectric sensor and configured to detect the presence of toner at that position. When the toner sensor 70 does not detect toner, the toner container 30Y is driven to supply toner from the toner container 30Y to the reservoir 66. When the toner sensor 70 continues to indicate that toner is not present even though such a supply operation is performed, the toner container 30Y is deemed empty or substantially empty (the end of toner). Then, a display of the image forming apparatus 100 indicates that.

The conveying screw 67 is rotated, basically, in accordance with consumption of toner in the developing device 5Y. Specifically, when the concentration detector 56Y illustrated in FIG. 2 detects that the concentration of toner in developer G in the developing device 5Y is insufficient, a controller of the image forming apparatus 100 sends a signal to drive the driving motor (at least one of the driving motors to dive the respective toner containers 30Y), and additionally the driving motor to drive the conveying screw 67 is driven.

As described above, the spiral protrusion 32 is disposed on the inner circumferential face of the container body of the toner container 30Y. With this configuration, as the container body (toner container 30Y) rotates, toner is transported from the bottom side of the toner container 30Y (upstream side in the insertion direction C) to the outlet 31 on the head side, and the toner discharged through the outlet 31 flows down the cap cover 63 into the reservoir 66 through the inlets 71.

The toner stored in the reservoir 66 is discharged from the opening 72 and supplied to the developing device 5Y.

Next, the configuration and operation of the image forming apparatus 100 according to the present embodiment are described in further detail below.

As described above, the image forming apparatus 100 according to the present embodiment includes the removably mountable process cartridges 6 (6Y, 6M, 6C, and 6K), the toner supply devices 60 (60Y, 60M, 60C, and 60K) to which the process cartridges 6 are connectable (i.e., the apparatus-side connectable devices), and the intermediate transfer unit 15 serving as the drawer unit.

The process cartridge 6Y is removably mountable in the body 100A of the image forming apparatus 100 and includes the developing device 5Y to develop the latent image on the photoconductor drum 1 (i.e., the image bearer) into a toner image. The process cartridge 6Y (including the developing device 5Y) is drawn out from the image forming apparatus 100 (the toner supply device 60Y) in the direction indicated by arrow C1 (hereinafter also "drawn-out direction C1") in FIGS. 3, 4, and 7 and inserted into the image forming apparatus 100 in the insertion direction C, which is opposite the direction indicated by arrow C1.

Referring to FIG. 3, the toner supply device 60Y (the apparatus-side connectable device) includes the opening 72 (i.e., a flow-out opening) to be connected to the opening 57Y (supply inlet) of the process cartridge 6. Toner is received from the toner supply device 60 to the process cartridge 6Y via the opening 57Y and the opening 72.

Specifically, the toner supply device 60Y supplies the toner (developer) to the toner supply device 60Y as described above. In conjunction with insertion and removal of the process cartridge 6Y into and from the toner supply device 60Y (the image forming apparatus 100), the opening 57Y and the opening 72 are connected to (communicate with) and disengaged from each other.

Additionally, referring to FIG. 3, the toner supply device 60Y includes a shutter 75 to open and close the opening 72 (in particular, at least one of the opening 57Y and the opening 72 positioned upper than the other) in conjunction with insertion and removal of the process cartridge 6Y from the toner supply device 60Y.

Specifically, the shutter 75 is supported on the bottom of the toner supply device 60 (the reservoir 66 in particular) so that the shutter 75 moves in the directions indicated by arrows C and C1, thereby opening and closing the opening 72. A compression spring is disposed on the bottom of the toner supply device 60Y (the reservoir 66) to bias the shutter 75 to the right in FIG. 3 to close the opening 72. With this configuration, when the process cartridge 6Y is inserted into the toner supply device 60Y, a projection of the process cartridge 6Y pushes the shutter 75 against the bias force exerted by the compression spring. Then, the opening 72 is opened and connected to the opening 57Y. By contrast, when the process cartridge 6Y is removed from the toner supply device 60Y, the shutter 75 is released from the projection of the process cartridge 6Y. Then, the compression spring pushes the shutter 75 and closes the opening 72 with the bias force.

Providing the shutter 75 to the opening 72 can reduce the amount of toner dropping from the opening 72 to the interior of the image forming apparatus 100 in the process of removal of the process cartridge 6Y from the toner supply device 60Y.

It is to be noted that, although the toner supply device 60Y according to the present embodiment includes the shutter 75 to open and close the opening 72, in another embodiment, a shutter to open and close the opening 57Y is provided.

Figure 4:
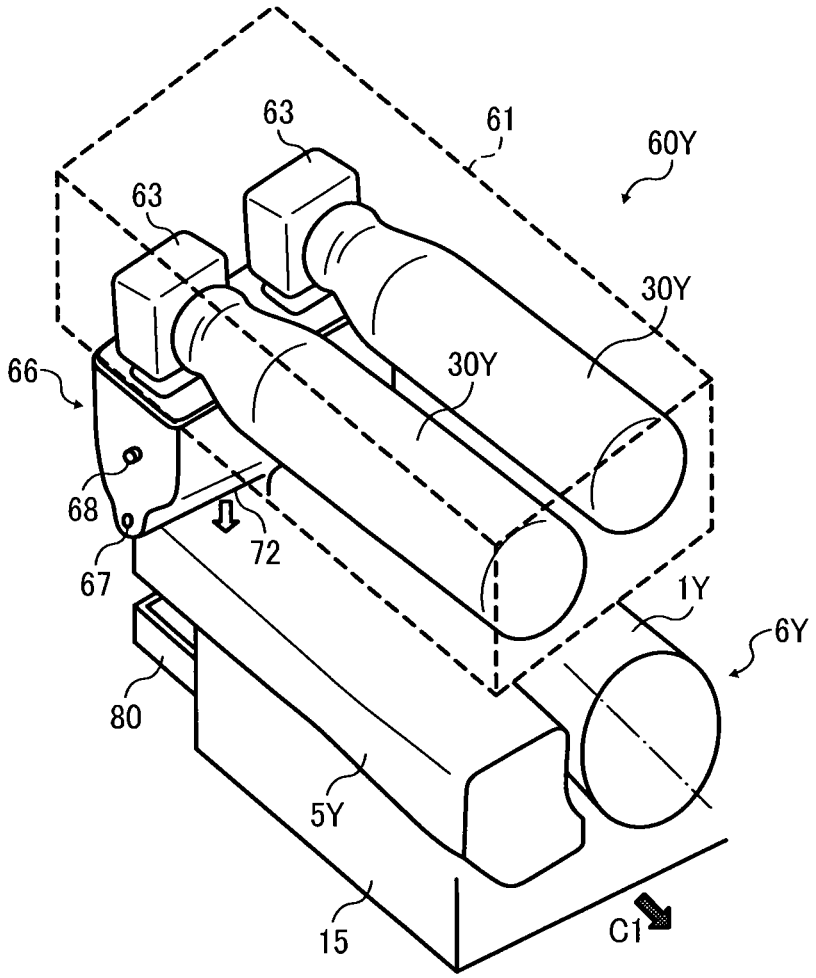
FIG. 4 is a schematic perspective view illustrating two toner containers mounted in the toner supply device illustrated in FIG. 3.
Figure 7:
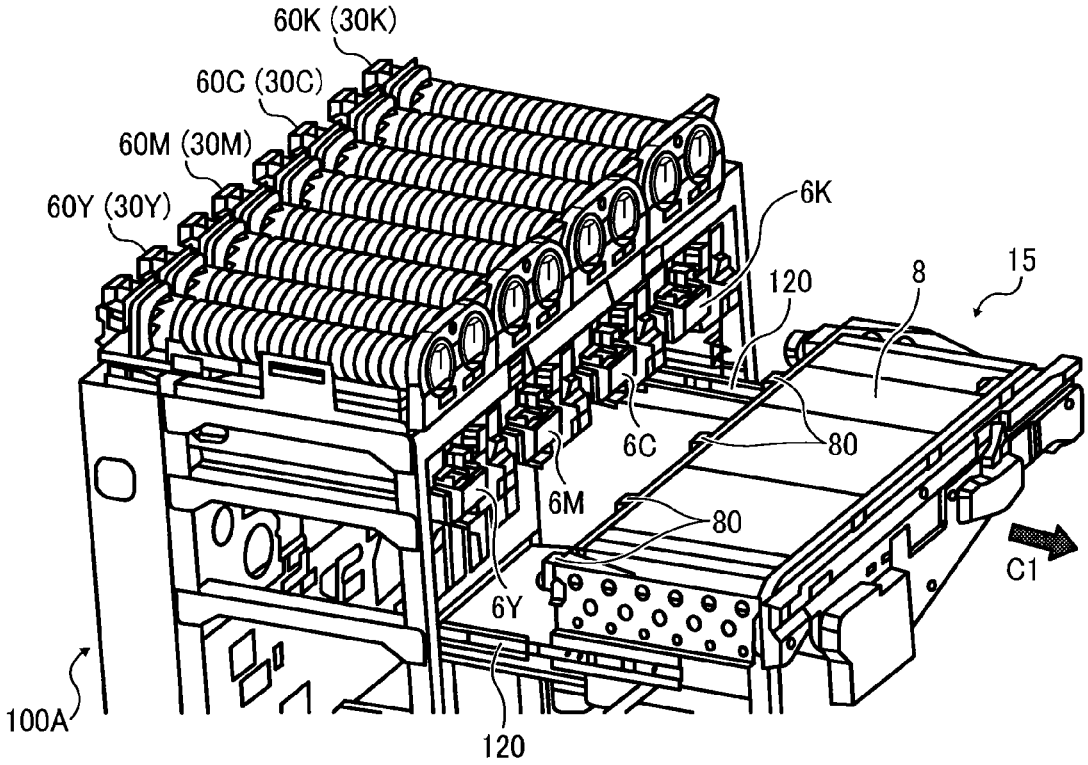
FIG. 7 is a perspective view illustrating an intermediate transfer belt, together with a receptacle, drawn out from a body of the image forming apparatus.

Referring to FIGS. 3, 4, and 7, the intermediate transfer unit 15 (the drawer unit) is designed to be drawn out from the image forming apparatus 100.

The intermediate transfer unit 15 is positioned close to the process cartridges 6. Referring to FIG. 7, the image forming apparatus 100 further includes slide rails 120 to support the intermediate transfer unit 15 slidably in the drawn-out direction C1, which is horizontal or substantially horizontal. Accordingly, the process cartridge 6Y (the removable unit) is installed into the body 100A and removed therefrom in identical directions as the directions in which the intermediate transfer unit 15 (the drawer unit) is retracted into the body 100A and drawn out therefrom.

Referring to FIGS. 3, 4, and 7, the image forming apparatus 100 according to the present embodiment further includes a toner receptacle 80 positioned below the opening 57Y of the developing device 5Y and the opening 72 (at the position connected to each other). The toner receptacle 80 receives the toner dropping from the opening 57Y or the opening 72 and stores the toner. Disposing the toner receptacle 80 below the position where the opening 72 is connected to the opening 57Y is advantageous as follows. In installation or removal of the process cartridge 6Y in and from the toner supply device 60Y, when the toner adhering to the vicinity of the opening 72 (or the opening 57Y) drops, the toner is stored in the toner receptacle 80, thereby inhibiting contamination inside the image forming apparatus 100.

The toner receptacle 80 is an integral part of the intermediate transfer unit 15 (the drawer unit) and designed to be drawn out from the image forming apparatus 100 together with the intermediate transfer unit 15. Specifically, the toner receptacle 80 is disposed on the back side of the intermediate transfer unit 15 in the drawn-out direction C1 (on the back side of the body 100A where the reservoir 66 is located) as viewed from the side to which the intermediate transfer unit 15 is pulled. For example, the toner receptacle 80 is shaped like a box-having an open top.

With this configuration, in a state in which the process cartridges 6 are mounted in the body 100A as illustrated in FIG. 7, the toner receptacle 80 can be horizontally drawn out to the front side of the body 100A in a balanced posture without interfering with the intermediate transfer belt 8 and the like positioned close to the process cartridges 6. Thus, cleaning of the toner receptacle 80 is relatively easy.

In particular, in the present embodiment, the connection between the developing device 5Y (the opening 57Y) and the toner supply device 60Y (the opening 72) is positioned on the back side of the body 100A, and accordingly the toner receptacle 80 is disposed on the back side of the body 100A, the access to which is difficult. Thus, the above-described configuration to draw out the toner receptacle 80 is helpful.

Since the toner receptacle 80 is united with the intermediate transfer unit 15 drawn out along the slide rails 120 in the present embodiment, the toner receptacle 80 is drawn out in a balanced manner while keeping a horizontal posture.

It is to be noted that the capacity of the toner receptacle 80 is preferably greater than the amount of toner accumulating while the process cartridge 6Y is repeatedly replaced (removed and mounted) in a maintenance cycle of the process cartridge 6Y.

Additionally, referring to FIG. 3, a seal 85 is attached to the side plate 110 of the body 100A. The seal 85 is made of polyurethane foam or the like, for example. The seal 85 fills in clearance between the toner receptacle 80 and the side plate 110 in a state in which the intermediate transfer unit 15 is mounted in the body 100A as illustrated in FIG. 3. The toner dropping from above is prevented from dropping further by the seal 85.

It is to be noted that the location of the toner receptacle 80 is not limited to below the position where the opening 57Y of the developing device 5Y is connected to the opening 72 of the toner supply device 60Y (the apparatus-side connectable device) to receive the toner dropping from the opening 72.

Figure 8:
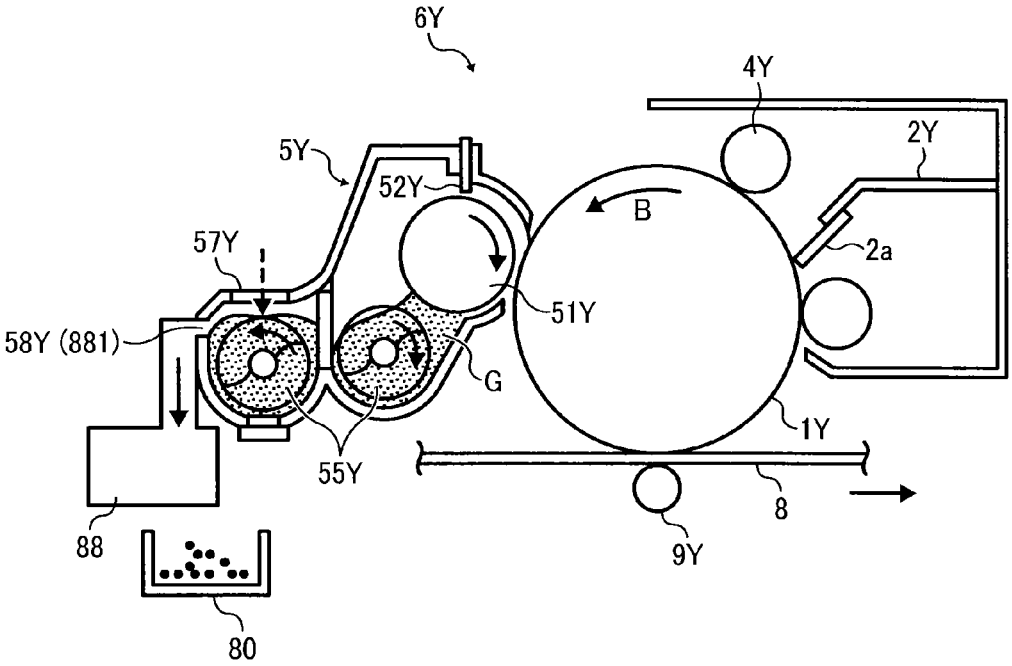
FIG. 8 is a schematic cross-sectional view of a process cartridge and the vicinity thereof according to Variation 1.

Alternatively, the aspects of the present specification are applicable to the configuration illustrated in FIG. 8, which includes a developer collecting device 88 (a collected developer container) to collect a portion of or entire two-component developer G contained in the developing device 5Y. The developing device 5Y illustrated in FIG. 8 employs premix developing. For example, JP-5123231-B discloses such a configuration. Two-component developer is supplied from a developer container to the developing device 5Y. Excessive developer G is discharged from the developing device 5Y via an opening 58Y of the developing device 5Y and collected in the developer collecting device 88 via an opening 881 (i.e., an apparatus-side opening) of the developer collecting device 88 as waste developer. The opening 58Y of the developing device 5Y serving as the removable unit is connected to and disengaged from the opening 881 of the developer collecting device 88 (an apparatus-side connectable device) in conjunction with installation and removal of the developing device 5Y.

In the configuration illustrated in FIG. 8, the toner receptacle 80 is disposed below the opening 58Y and the opening 881 and united with the intermediate transfer unit 15 to be drawn out together with the intermediate transfer unit 15. Then, effects similar to those described above are attained.

The aspects of the present specification can adapt to a configuration in which the waste-toner container 90 illustrated in FIG. 1 is a removable unit to be removably mounted in the image forming apparatus 100.

Figure 9:
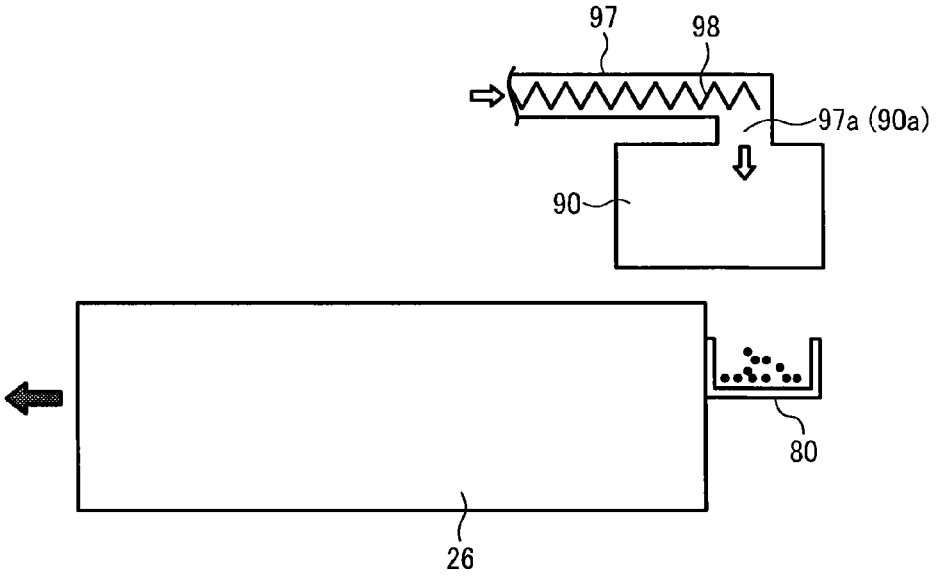
FIG. 9 is a schematic view of a waste-toner container and the vicinity thereof according to Variation 2.

Specifically, referring to FIG. 9, in the waste-toner container 90, the untransferred toner removed by the cleaning device 2 and the belt cleaner is collected as waste toner. The toner collected by the cleaning device 2 and the belt cleaner is transported through a toner conveying tube 97, in which a conveying screw 98 is disposed. An opening 90*a* of the waste-toner container 90 serving as the removable unit is coupled to and disengaged from an opening 97*a* of the toner conveying tube 97 (the cleaning device 2 or the belt cleaner serving as an apparatus-side connectable device) in conjunction with installation and removal of the waste-toner container 90.

In the configuration illustrated in FIG. 9, the toner receptacle 80 is disposed below the opening 90*a* and the opening 97*a* (the apparatus-side opening) and united with the sheet feeder 26 serving as a drawer unit to be drawn out from the body 100A. Then, the toner receptacle 80 is drawn out together with the sheet feeder 26, and effects similar to those described above are attained.

It is to be noted that, alternatively, in a configuration in which the duplex conveyor unit 95 is disposed adjacent to and below the waste-toner container 90 and the duplex conveyor unit 95 is drawable from the body 100A to remove jammed sheets at the time of paper jam, the toner receptacle 80 is united with the duplex conveyor unit 95 instead of the sheet feeder 26.

As described above, in the above-described embodiment, the toner receptacle 80 is disposed below the position where the opening 57Y of the process cartridge 6Y (the removable unit) is connected to the opening 72 of the toner supply device 60Y (the apparatus-side connectable device) to receive the toner dropping thereto. The toner receptacle 80 is united with the intermediate transfer unit 15 (the drawer unit) and designed to be drawn out from the image forming apparatus 100 together with the intermediate transfer unit 15.

This configuration is advantageous in the configuration in which the opening 57Y of the process cartridge 6Y and the opening 72 of the toner supply device 60Y are coupled together to send toner from one of them to the other and the toner receptacle 80 is disposed below the openings 57Y and 72 to receive the toner dropping from the vicinity of the openings 57Y and 72 in installation and removal of the process cartridge 6Y from the toner supply device 60Y. Advantageously, the toner receptacle 80 does not interfere with other components and cleaning of the toner receptacle 80 is easy.

Additionally, in the description above, the photoconductor drum 1Y serving as the image bearer, the charging device 4Y, the developing device 5Y, and the cleaning device 2Y are united with each other as the process cartridge 6Y. However, in another embodiment, the photoconductor drum 1Y, the charging device 4Y, the developing device 5Y, and the cleaning device 2Y are independently installable in and removable from the image forming apparatus 100. In yet another embodiment, a part of these components are united with each other as the process cartridge 6Y to be installed and removed from the image forming apparatus 100. In such configurations, the developing device 5Y serves as the removable unit according to the above-described embodiment, and effects similar to those described above are attained.

It is to be noted that the term "process cartridge" used in this specification means an integrated unit including an image bearer and at least one of a charging device, a developing device, and a cleaning device housed in a common unit casing that is removably installed in the image forming apparatus.

Additionally, although the multiple toner containers 30 including the substantially cylindrical, rotatable container bodies are removably installed in the toner supply device 60Y in the description above, the number and the shape of the toner containers 30Y mounted in the toner supply device 60Y are not limited thereto. The aspects of this specification can adapt to toner supply devices to which, for example, a box-shaped toner container is mounted.

Figure 10:
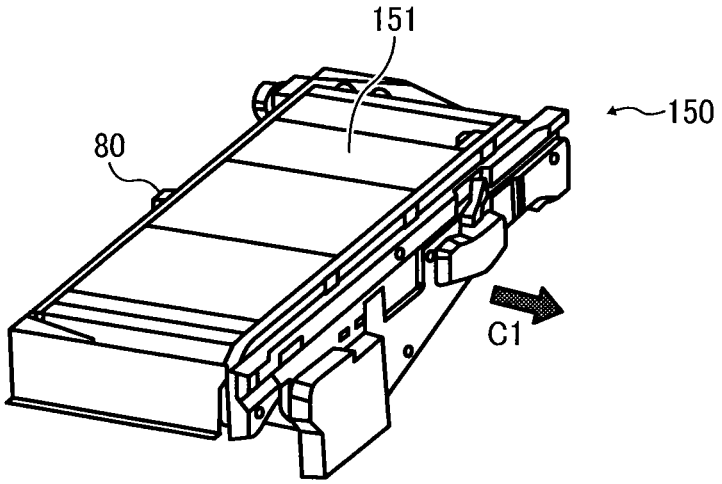
FIG. 10 is a schematic perspective view of a transfer unit according to another embodiment.

Although the description above concerns the multicolor image forming apparatus 100 that includes the multiple process cartridges 6 (the image forming units), the aspects of this specification can adapt to a single-color or monochrome image forming apparatus including a single image forming unit. In such a configuration, as illustrated in FIG. 10, the toner receptacle 80 can be united with, instead of the intermediate transfer unit 15, a transfer unit 150 to transfer a toner image from the image bearer onto a recording medium. The transfer unit 150 includes a transfer belt 151 to transport the recording medium.

Alternatively, in a configuration in which the process cartridge 6Y (the removable unit) is adjacent to a unit, such as the duplex conveyor unit 95 or the sheet feeder 26, other than the intermediate transfer unit 15, such a unit is configured as the drawer unit, with which the toner receptacle 80 is united.

In such configurations, effects similar to those described above are also attained.

Numerous additional modifications and variations are possible in light of the above teachings. It is therefore to be understood that, within the scope of the appended claims, the disclosure of this patent specification may be practiced otherwise than as specifically described herein. Such variations are not to be regarded as a departure from the scope of the present disclosure and appended claims, and all such modifications are intended to be included within the scope of the present disclosure and appended claims. The number, position, and shape of the components of the image forming apparatus described above are not limited to those described above.

What is claimed is:

1. An image forming apparatus, comprising:

a removable unit to be removably installed in the image forming apparatus, the removable unit having a unit-side opening;

a connectable device having an apparatus-side opening to be connected to the unit-side opening to send developer from one of the removable unit and the connectable device to the other of the removable unit and the connectable device;

a drawer unit to be retractably drawn out from the image forming apparatus; and a receptacle disposed below the unit-side opening and the apparatus-side opening to receive and store developer dropping from above, the receptacle united with the drawer unit to be drawn out from the image forming apparatus together with the drawer unit, wherein the receptacle is disposed on a back side of the drawer unit in a drawing-out direction in which the drawer unit is drawn out from the image forming apparatus, the removable unit is removed from the image forming apparatus in a direction identical to the drawing-out direction, and the drawer unit is disposed adjacent to the removable unit in the image forming apparatus.

2. The image forming apparatus according to claim 1, further comprising an image bearer to bear a latent image on a surface thereof, wherein the removable unit includes a developing device to develop the latent image on the surface of the image bearer; and the connectable device includes a developer supply device to supply the developer to the developing device.

3. The image forming apparatus according to claim 2, wherein the removable unit includes the image bearer.

4. The image forming apparatus according to claim 1, further comprising an image bearer to bear a latent image on a surface thereof, wherein the removable unit includes a developing device to develop the latent image on the surface of the image bearer; and the connectable device includes a developer collecting device to collect the developer discharged from the developing device.

5. The image forming apparatus according to claim 4, wherein the removable unit includes the image bearer.

6. The image forming apparatus according to claim 1, further comprising an image bearer to bear a latent image on a surface thereof, wherein the connectable device includes a cleaning device to remove toner from the surface of the image bearer, and the removable unit includes a waste-toner container to collect the toner removed by the cleaning device.

7. The image forming apparatus according to claim 1, further comprising an image bearer to bear a latent image on a surface thereof, wherein the drawer unit is one of:

an intermediate transfer unit having a transfer belt onto which a toner image is transferred from the image bearer, a transfer unit to transfer the toner image from the image bearer onto a recording medium, a sheet feeder to contain the recording medium, and a sheet reversal unit to reverse the recording medium upside down to form another toner image on a back side of the recording medium after toner image formation on a front side of the recording medium.

8. The image forming apparatus of claim 1, further comprising a shutter to open and close at least an upper one of the unit-side opening and the apparatus-side opening in conjunction with connecting and removing of the removable unit to and from the connectable device.

9. An image forming apparatus, comprising:

a removable unit to be removably installed in the image forming apparatus, the removable unit having a unit-side opening;

a connectable device having an apparatus-side opening to be connected to the unit-side opening to send developer from one of the removable unit and the connectable device to the other of the removable unit and the connectable device;

a drawer unit to be retractably drawn out from the image forming apparatus; and a receptacle disposed below the unit-side opening and the apparatus-side opening to receive and store developer dropping from above, the receptacle united with the drawer unit to be drawn out from the image forming apparatus together with the drawer unit, the image forming apparatus further comprising a shutter to open and close at least an upper one of the unit-side opening and the apparatus-side opening in conjunction with connecting and removing of the removable unit to and from the connectable device.

10. The image forming apparatus of claim 9, wherein the receptacle is disposed on a back side of the drawer unit in a drawing-out direction in which the drawer unit is drawn out from the image forming apparatus, the removable unit is removed from the image forming apparatus in a direction identical to the drawing-out direction, and the drawer unit is disposed adjacent to the removable unit in the image forming apparatus.

11. The image forming apparatus of claim 9, further comprising an image bearer to bear a latent image on a surface thereof, wherein the removable unit includes a developing device to develop the latent image on the surface of the image bearer; and the connectable device includes a developer supply device to supply the developer to the developing device.

12. The image forming apparatus of claim 11, wherein the removable unit includes the image bearer.

13. The image forming apparatus of claim 9, further comprising an image bearer to bear a latent image on a surface thereof, wherein the removable unit includes a developing device to develop the latent image on the surface of the image bearer; and the connectable device includes a developer collecting device to collect the developer discharged from the developing device.

14. The image forming apparatus of claim 13, wherein the removable unit includes the image bearer.

15. The image forming apparatus of claim 9, further comprising an image bearer to bear a latent image on a surface thereof, wherein the connectable device includes a cleaning device to remove toner from the surface of the image bearer, and the removable unit includes a waste-toner container to collect the toner removed by the cleaning device.

16. The image forming apparatus of claim 9, further comprising an image bearer to bear a latent image on a surface thereof, wherein the drawer unit is one of:

an intermediate transfer unit having a transfer belt onto which a toner image is transferred from the image bearer, a transfer unit to transfer the toner image from the image bearer onto a recording medium, a sheet feeder to contain the recording medium, and a sheet reversal unit to reverse the recording medium upside down to form another toner image on a back side of the recording medium after toner image formation on a front side of the recording medium.

* * * * *